US005616010A

United States Patent [19]

Sawyer

[11] Patent Number: 5,616,010

[45] Date of Patent: Apr. 1, 1997

[54] MULTIPLE CYLINDER ENGINE FEATURING A RECIPROCATING NON-ROTATING PISTON ROD

[76] Inventor: James K. Sawyer, 10311 Sagecourt Dr., Houston, Tex. 77089

[21] Appl. No.: 554,006

[22] Filed: Nov. 6, 1995

[51] Int. Cl.[6] ..... F04B 17/05

[52] U.S. Cl. ..... 417/364; 123/DIG. 8

[58] Field of Search ..... 123/DIG. 8; 417/364, 417/380

[56] References Cited

U.S. PATENT DOCUMENTS

| | | | |
|---|---|---|---|
| 4,093,405 | 6/1978 | Brian | 417/343 |
| 4,115,037 | 9/1978 | Butler | 417/364 |
| 4,362,477 | 12/1982 | Patten | 417/364 |
| 4,369,021 | 1/1983 | Heintz | 417/364 |
| 4,648,806 | 5/1987 | Alexander | 417/238 |
| 4,776,166 | 10/1988 | Dixon | 417/364 |
| 4,992,031 | 2/1991 | Sampo | 417/364 |

*Primary Examiner*—Timothy Thorpe
*Assistant Examiner*—Peter G. Korytnyk
*Attorney, Agent, or Firm*—Gunn & Associates, P.C.

[57] ABSTRACT

The present disclosure is directed to a power plant, and especially two or more such power plants connected together. The power plant especially features a piston connected with a reciprocated but non-rotating piston rod which connects with a pump piston at the opposite end. Power is generated by the power piston and imparted through straight reciprocating motion to the pumped piston. Two or more of these power plants are operated together by connecting them together through a connective mechanical link so that operation of one times the operation of two or more units slaved to the first. Synchronized operation is obtained.

12 Claims, 3 Drawing Sheets

53
48
51
52
46
44
45
45
43
41
42
47
40
48
18
50
30

85
87
SHUTTLE SWITCH
PRESSURE ACCUM.
V
86
60
66
PP1
PUMP 1
62
V
FUEL PUMP
95
61
63
64
75
PP4
70
PP2
PUMP 2
V
69
80
68
MANI-FOLD
CLUTCH CONTROL
76
65
PP3
PUMP 3
V
77
PP4
PUMP 4
V
89
PRESSURE SENSOR
90
STARTER SWITCH
88
81
91
82

MULTIPLE CYLINDER ENGINE FEATURING A RECIPROCATING NON-ROTATING PISTON ROD

BACKGROUND OF THE DISCLOSURE

The present disclosure is a continuation-in-part from the disclosure which is set forth in U.S. Pat. No. 5,464,331 of Nov. 7, 1995. In that patent, a powered reciprocating piston connected with the piston rod is set forth. One special note in that disclosure is an arrangement in which the piston rod is reciprocated but does not rotate. Specifically, the rod is reciprocated in linear or axial so that rotation is not needed. The present disclosure sets forth additional structure so that so that two or more such piston powered engines can be connected together to operate as a larger power plant. The device of the identified patent can be built so that scaling up to larger sizes provides for a larger power plant. While this can be done with few technical limits on increased size, there is the practical limit that larger sizes may provide the necessary power with sharp power surges. One of the advantages of a smaller version provided with two, three, or four identical piston and cylinder arrangements is that smoother operation can then be obtained. For smoother operation, multiple units can be operated together. The present disclosure sets forth certain aspects of putting two or more of the single power piston engines together. As an example, the device can have two, three, or four power pistons connected to the same number of reciprocating piston rods, and thereby operate a similar number of compression cylinders or the like.

In assembling two or more of the powered pistons in conjunction with the dedicated, straight, non-rotating piston rods, advantages of scale are achieved with the benefit of a smoother flow with smaller pulsations in a pumping system. As shown in the parent disclosure, a power piston is arranged at one end of a piston rod. A pump cylinder and piston is arranged at the opposite end and represents the load which is placed on the power piston. The pump end provides an output flow which has pressure peaks in it timed with the stroke of the power piston applied to the piston rod. These pulsations in pressure can be smoothed by using a downstream pressure accumulator. By omitting the pressure accumulator, smoothing can also be obtained through the use of two, three, or four pump pistons connected to a common manifold so that the common manifold is able to smooth the many surges. In smoothing the surges, a different and better mode of operation is obtained.

In one aspect of the present disclosure, two cooperative power plants which could otherwise run completely independently of the operation of the other are arranged so that they run together and system control is then obtained. The system control enables the multiple duplicate units to operate together or jointly. When joint operation is achieved, there are certain economies that result from the joint operation and the economies include a reduction in the number of duplicated components. The number of lubrication oil pumps which are used in the system can be reduced. Moreover, the several power plants which would otherwise be independent are harnessed together so that they operate in synchronized relationship. While the specifics of the synchronization can vary, it is important to assure that four such power plants (to pick a specific example) operate together so they are subject to a single control and therefore provide load adaptability as a single unit. While there are advantages to one unit, even more advantages can be obtained by yoking four otherwise independent power plants together so that they operate in unison.

The present disclosure also sets forth a system in which piston operation is timed with respect to a reference event, and the reference is typically operation of a duplicate set of equipment. Using the example of four such units, they can be timed so that the four units provide the requisite power for any load that might be imposed on the system.

SUMMARY OF THE INVENTION

Going now to the system of the present disclosure, it is summarized as a set of two or more power plants in accordance of the teachings of U.S. Pat. No. 5,464,331 which, rather than operate independently, are joined together for cooperative operation so that two or more such units run together. They are synchronized in their operation with respect to each other. Moreover, the complexity is reduced by the omission of such auxiliary but essential equipment, i.e., electric alternators, lubrication oil pumps and the like. These are omitted so that one unit can provide adequate lubricating oil flow for all units.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
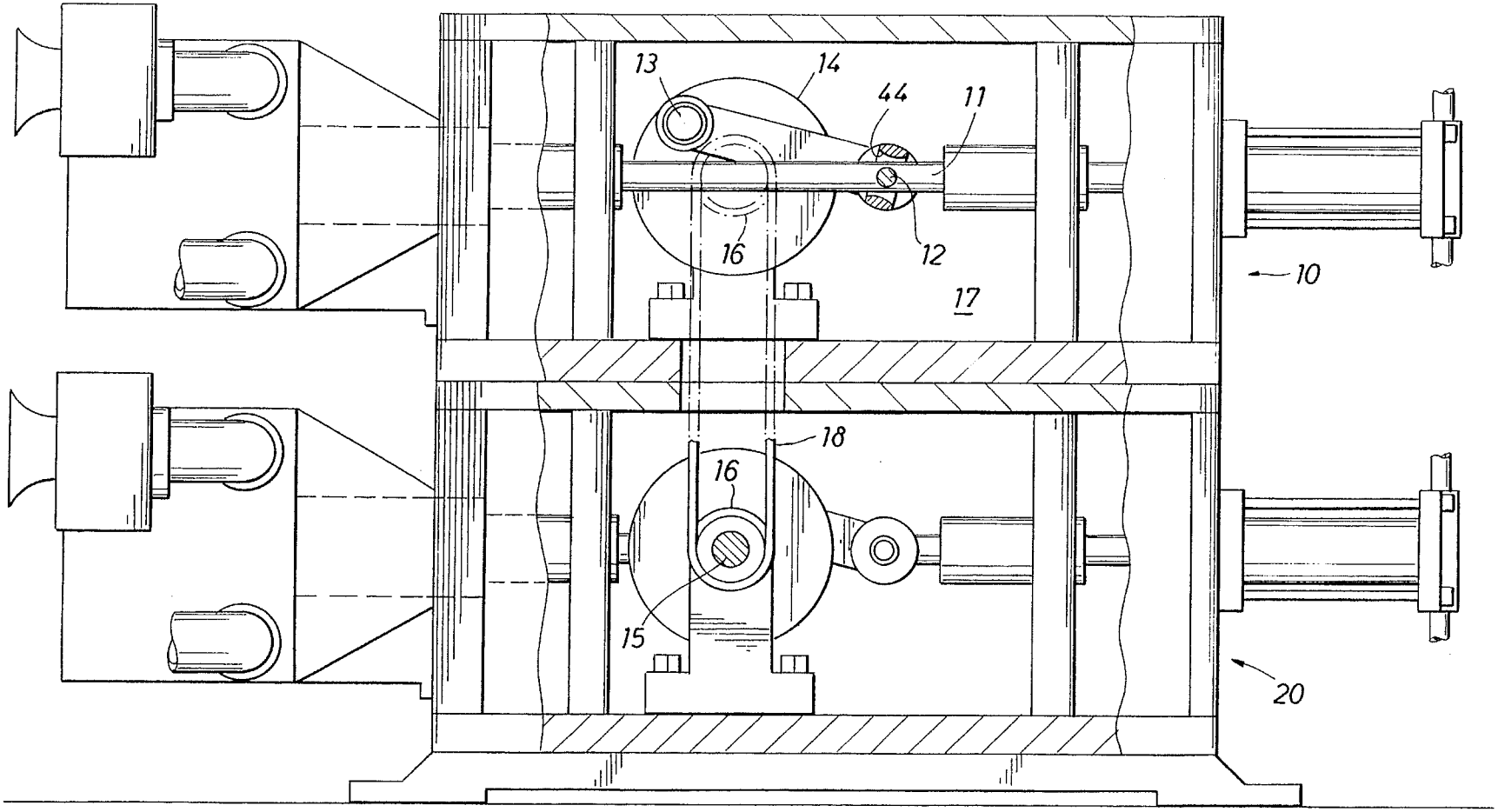
FIG. 1 is a sectional view through two power plants having a straight rod connected between a power piston and a pump piston and wherein two separate power plants are operated together by synchronization thereof through a connective link connecting the two power plants.

Attention is now directed to FIG. 1 of the drawings which illustrates two separate engines which have been joined together. To define the terms in a useful fashion, the numeral 10 identifies one engine in accordance with the teachings of the above-referenced issued patent. That device is made complete and operative and will be described as an engine or power plant. That is, it is a device which features the power piston, the pump piston, and the straight rod which connects between the two. In like fashion, the numeral 20 identifies a second and similar power plant. The two power plants are preferably identical in size and construction. However, it is not mandatory that they be equal in size. Indeed, they can have different sizes and can be scaled with different capacities in the power pistons to pick an example. For instance, the power piston in the engine 10 can have twice the displacement by increasing the diameter of the piston. Likewise, the power piston in the pump 20 can be smaller, equal, or larger. What is important to note is that the two engines 10 and 20 are substantially similar. For the sake of convenience, they are shown to be equal in size and have equal strokes because common dimensions have been applied to both units. This is typically a manufacturing convenience to reduce cost, and it is also typically a manufacturing convenience to enhance the connection of the two so that they are operated with common strokes and movements.

The two engines are connected together so that they operate together. Power is generated by reciprocating motion so that the two are able to operate in synchronized fashion.

Going now to FIG. 1 of the drawings and focusing solely on the engine 10, the rod 11 is reciprocated in an axial movement to and fro or to the right and left as shown in the drawings. It is intercepted by a transverse pin 12 which is joined to it. The pin 12 extends to an eccentrically mounted shaft 13. The shaft is rotated, and thereby rotates a small fly wheel 14. All of the equipment described to this juncture typically is involved in a power take off mechanism for rotation of an alternator or a fuel pump or lubrication fuel pump. Such devices are powered by connecting the fly wheel 14 to rotate a shaft 15 (the reference numeral is applied to the engine 20 because clarity of drawing obscures the shaft 15 in the embodiment 10) and that rotates the connected equipment.

The shaft 15 is incorporated for operation of such auxiliary equipment. The equipment is deemed to be auxiliary in the sense that it does not create power but it provides needed services for the engine 10. In this particular instance, advantage is taken of the shaft 15 by mounting on the shaft 15 a sprocket 16 which is shown in dotted line in FIG. 1. A sprocket is ideally keyed to the shaft to rotate with the shaft. The shaft additionally connects with lubrication oil pumps and the like. For purposes of this disclosure, the shaft is normally located within the lubricated chamber 17, but is can also be mounted on the exterior of the chamber 17. At either location, the shaft is rotated at a rate of speed which is tied to or dependent on the rate of reciprocation of the rod 11. The shaft 15 is thus rotated and imparts power to the assessory equipment (defined as fuel pump, lubrication oil pump, electrical alternator, and other accessories for the engine). The flexible drive belt or chain 18 extends to engage a similar sprocket 16 located on the lower engine 20. As noted above, the sprockets 16 and the drive belt or chain 18 are vertically aligned. Conveniently, they can be located on the exterior of the lubrication chamber 17 or can extend down through the lubrication chamber 17. In the latter event, this would define a single unitized lubrication chamber extending between both engines. In that event, it would be desirable to have specific lubricating oil outlets located so that all the moving parts are appropriately lubricated. More desirably, the engines 10 and 20 are illustrated so that the drive belt or chain 18 connects vertically from engine to engine thereby providing synchronized operation of the two engines 10 and 20.

In use, the two engines will therefore operate in a synchronized fashion.

Figure 2:
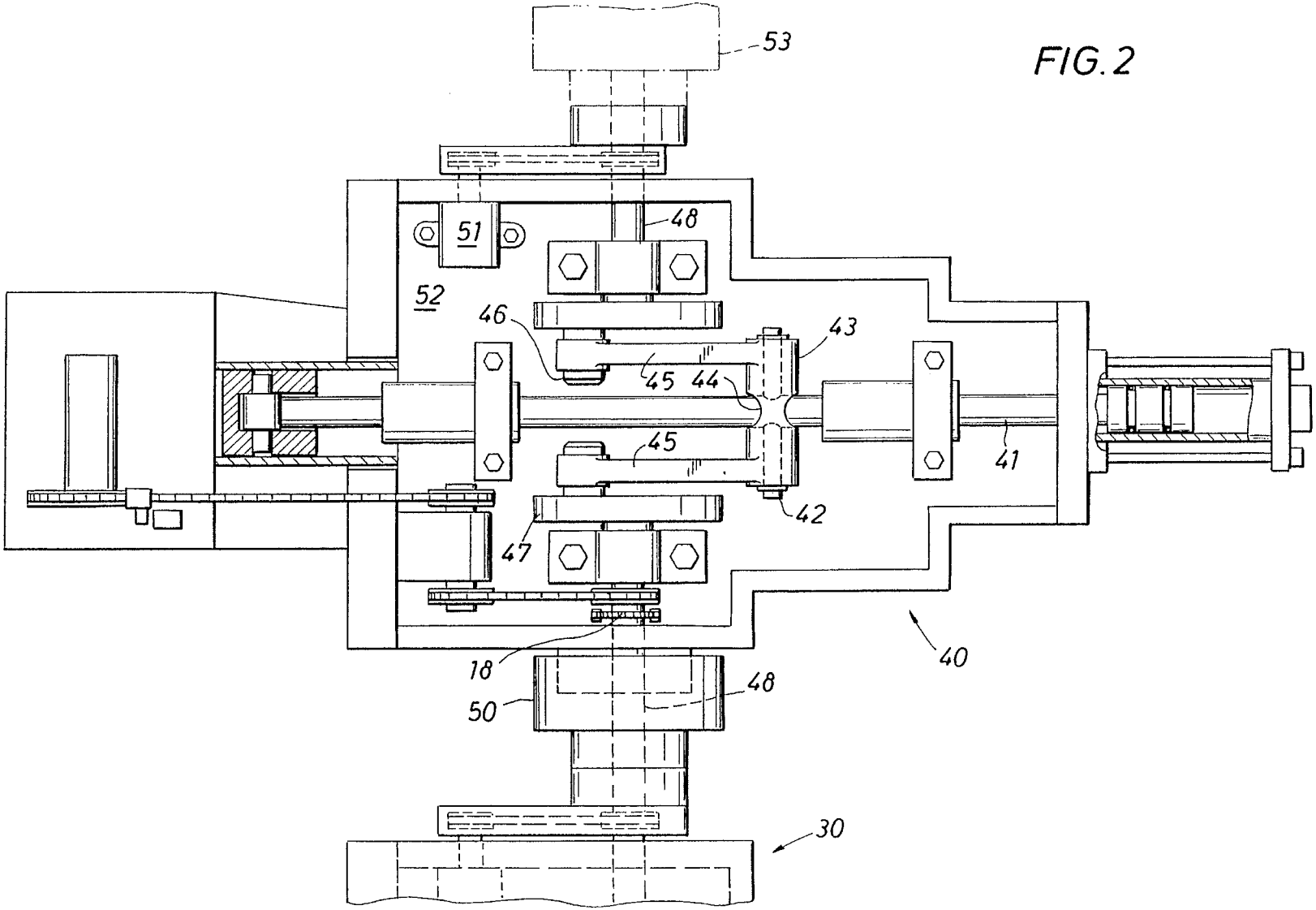
FIG. 2 is a plan view of one power plant showing a straight rod connected between opposing power piston and pump piston and further illustrating alternate connective links to enable comparable power plants to be operated in synchronization with the illustrated power plant.

Attention is now directed to FIG. 2 of the drawings which shows two engines 30 and 40 arranged in a side-by-side relationship. They are similar or identical, even identical in size and scale. Again, they can have different capacities, for instance by utilizing larger diameter pistons. FIG. 2 is an enhancement of the disclosure shown in FIG. 1 in the sense that the connective link, including the flexible belt or link chain is shown internally of the lubrication chamber. In particular, the engine 40 incorporates the flexible belt 18 to show an inside location of it; as previously mentioned, it can be placed on the exterior, i.e., outside the oil lubrication chamber 17.

Going now to specifics of the structure shown in FIG. 2, a non-rotating reciprocating rod 41 moves left and right in FIG. 2 of the drawings. It is joined by a suitable transverse pin 42 which is located centrally of a larger transverse wrist pin 43. The wrist pin 43 is larger and is constructed with a transverse passage through it, the passage being enlarged as better shown in FIG. 1 of the drawings where the numeral 44 identifies a portion cutaway to permit the wrist pin 43 to wobble. In this aspect and using both FIGS. 1 and 2, it will be observed that the wrist pin 43 is joined to an eccentric connected arm 45 at one or both ends, and isolate through a limited angle. The angle of deflection of the eccentric arms 45 is an angle determined by the geometry of the diameter of the fly wheel 14 shown in FIG. 1 and the length of the lever or arm 45 shown in FIG. 2. Suffice to say, the eccentric arm is connected to an eccentric rod 46 and rotates the fly wheel 47. The fly wheel 47 connects with the shaft 48 shown in FIG. 2 of the drawings. As in the parent disclosure, the fly wheel is preferably duplicated left and right and the shaft 48 is likewise duplicated. This enables two separate shafts to be aligned to connect to inboard or outboard accessories. Again, accessories include such things as fuel pumps, lubricated oil pumps, starter motors, electric alternators and the like.

Continuing with FIG. 2 of the drawings, an electric alternator can be included on the exterior such as by mounting an alternator 50 on the shaft 48. This can provide electrical power for operation. As desired, a lubricating oil pump 51 can be located in the chamber 52. It is powered from the shaft 48. A starter motor 53 can be connected to the equipment if desired. The example can be extended to other auxiliary apparatus. Of importance to the present disclosure, the engine 40 is complete and self-contained and is now illustrated connected to the engine 30 by the common shaft 48. Since the shaft 48 connects between both engines 30 and 40, they operate at the same speed and are synchronized to run together. Utilizing a shaft of this type, the two engines 30 and 40 can have a synchronized power stroke, or the shaft 48 can be connected so that the engines 30 and 40 run with a fixed phase shift in operation. The fixed phase shift is therefore the desired 180° phase difference in operation. When one is providing a pump intake stroke, the other is providing a pump delivery stroke. Further, if three or four engines are connected together, they can be phase shifted and operation by some alternate fixed angle, one example being 90° phase shift using four pumps of similar construction. Operation of the engines 10, 20, 30, and 40 shown in FIGS. 1 and 2 is substantially the same as previously described in the parent disclosure.

CONTROL SYSTEM FOR MULTIPLE ENGINES

Figure 3:
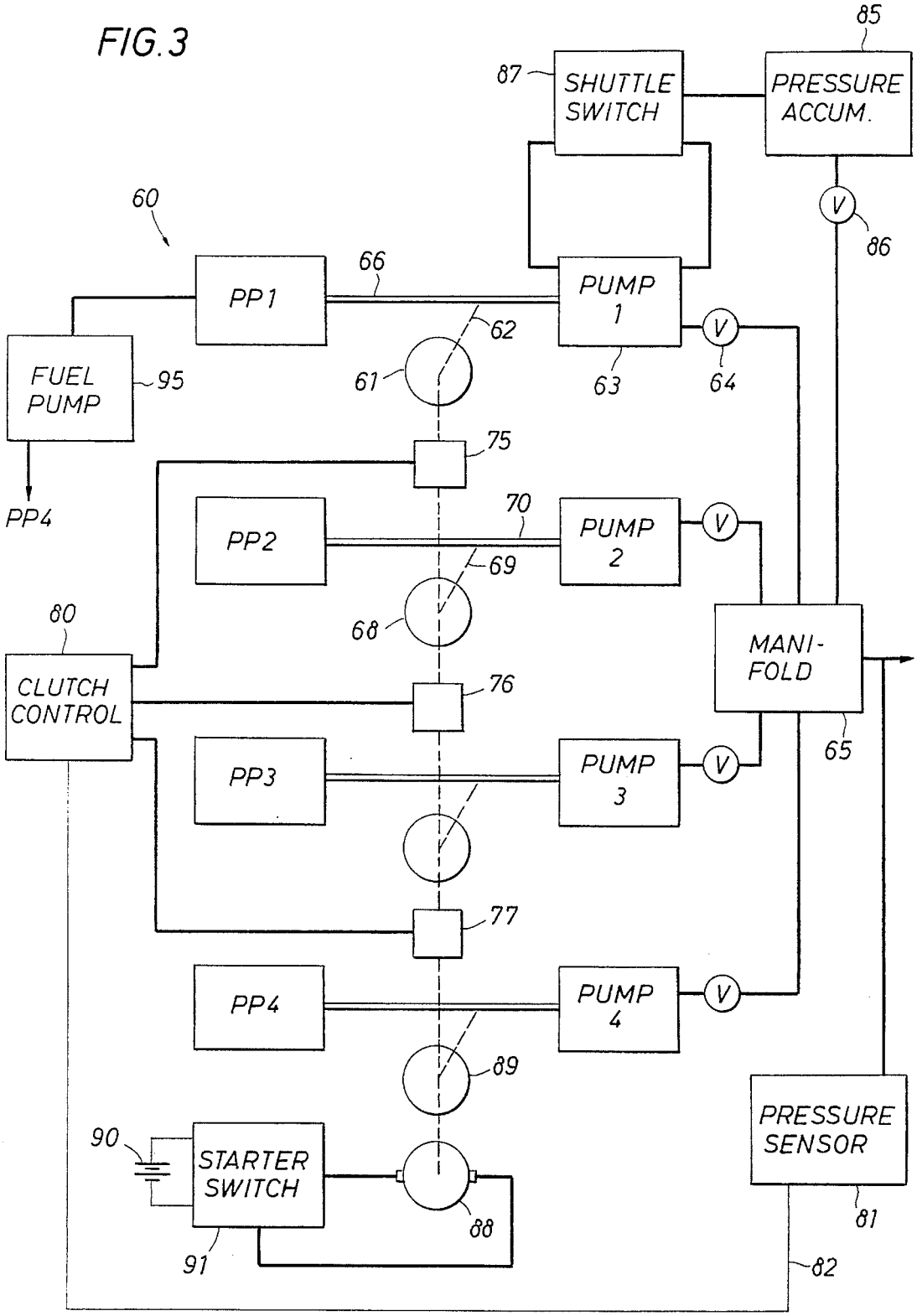
FIG. 3 is a control system for several engines connected together.

One feature of the present disclosure is the fact that several engines can be connected together to function as one power plant. Better than that, they can operated individually so that the wear is distributed evenly among the several engines. Consider a situation in which a particular power plant is sized so that four of the engines of the present disclosure are required. At times, only one will be needed, and at other times all four will be needed. To distribute the work load, the present disclosure contemplates connecting four of the engines of this disclosure so that they operate together. They can be switched off selectively so that the fuel consumption of the system is reduced. They can be operated collectively so that the power actually delivered is tailored to the precise requirements. In FIG. 3 of the drawings, such a system 60 is shown. The system 60 incorporates four of the engines such as the engines 10, 20, 30, and 40 previously described. Here, they are identified with the symbols PP1, 2, 3, 4. This refers to the power piston previously described, and FIG. 3 goes on to show the single connecting rod. The rod extends from the PP1 piston at the top of FIG. 3, and connects with the first pump. Ideally, all can be identical in size and dimension so that the four are equal. As will be understood, the explanation assumes the four are equal in size and further assumes that there are four in the system as illustrated. In fact, that can be varied by provision of different size power pistons and pumps. In the present disclosure however they are optimum if they are provided with equal stroke. If larger, they are made larger by increasing the diameter of the power piston.

Continuing with the description of FIG. 3, the first unit is identified at PP1, and powers a fly wheel 61 mechanically connected with it by the linkage 62. This is exemplified in FIGS. 1 and 2 of the drawings. It operates the pump 63. The pump can be made single acting as illustrated or can be made double acting. As a single acting pump, there is a check valve 64 on the output side which controls delivery from the pump to a manifold 65. The manifold 65 delivers the pump fluid through an outlet line.

The first of the several identical systems is provided with the fly sheet 61 which is connected to the piston rod 66. This takes off very little power from the system and is primarily involved in transfer of timed movement. FIG. 3 shows a second power piston which is identified by the symbol PP2. Likewise, it is provided with a flywheel 68 which is connected by a suitable mechanical linkage 69 to the piston rod 70. It operates in the same fashion as any of the engines mentioned before. In this particular instance, rotation of the flywheel 61 is coupled to the flywheel 68 through a magnetic clutch 75. The magnetic clutch 75 is mechanically connected between the two flywheels. For the moment, and referring specifically to FIG. 2 of the drawings, that view shows the engines 30 and 40 which are side-by-side, and further shows the shaft 48 which extends to the exterior of the lubricating chamber 52. The magnetic clutch is attached to the shaft 48 to provide mechanical linkage to the adjacent engine so that the engines 30 and 40 are coupled and rotate in unison. Alternately, the magnetic clutch can be installed in the hub of the sprocket 16 shown in FIG. 1. When disengaged, the belt or link chain drive 18 is simply not powered. The clutch has to be engaged to motion transfer. The clutch 75 therefore transfers timed rotational movement between PP1 and PP2.

FIG. 3 goes on to show two additional engines. They are connected together by similar magnetic clutches 76 and 77. The three magnetic clutches are subject to control by a clutch control circuit 80. This circuit provides the electrically powered signal to the magnetic clutches, causing them to engage or disengage.

Each of the engines operates the designated pump, and the pump delivers the output through a check valve to the manifold 65. The manifold in turn is connected with a pressure sensor 81 which measures the output pressure. Should the output pressure be too low or high, a signal indicative of that status is transferred on the signal line 82 extending to the clutch control circuit 80. An example of operation will be given in which a different number of operative engines is switched on to change the pressure at the manifold.

FIG. 3 shows two alternate starter devices. One such starter device utilizes a pressure accumulator 85. It builds up pressure within a small chamber and the pressure is held by a check valve 86 which prevents the pressure from bleeding from the accumulator 85. A shuttle switch 87 is connected to it. The shuttle switch is connected on both sides of the piston in the pump 63. The shuttle switch is operated, and thereby applies power in the form of fluid pressure to one side of the piston in the pump 63 and then to the other side. The shuttle switch provides high pressure pulses delivered on the opposite sides of the pump 63 so that the pump is reciprocated time and again. This can be used as a starter motor. It will provide reciprocating motion to the rod 66 which then reciprocates PP1. When that reciprocates, engine operation is initiated.

FIG. 3 shows only one such starter connected to only one of the four engines. The four engines need not be started all at the same instant. Rather, one is started then another is connected to the one that is running through the clutch connections just mentioned. An alternate form of starter is also shown in FIG. 3 of the drawings. The numeral 88 identifies an alternator. It is mechanically coupled with the flywheel 89 which is powered by PP4. The system also includes a battery 90 and a starter switch 91. The starter switch 91 is operated, thereby applying power from the battery 90 to the alternator 88. By appropriate connection of the battery 90 to the alternator 88, the alternator is then rotated because it functions as a motor. It is coupled as mentioned to the flywheel 89 and rotates it, thereby imparting power sufficient to start PP4.

Summarizing the starter situation, two different mechanics for starting operation are described. It is an advantage that each can be relatively small and not very expensive. This is obtained in part by connecting the starting motors just described to only one of the several engines. First one is started and then others can be started through clutch operation. The clutch control circuit 80 provides electrical power to the clutches 75, 76, and 77 for their operation. They are switched on to provide connection so that all of the engines are operation in a synchronized relationship.

The clutches are operated to enable operation of the selectively single engines. FIG. 3 also shows the fuel which is connected to PP1. The fuel pump is likewise connected to make fuel available for all units. The fuel pump 95 is preferably controlled so that fuel is delivered as required to a particular engine. In long term use and operation, it is especially beneficial to the several engines to operate them approximately for equal time to intervals. If need be, they can be switched on and off to more evenly distribute the load. If only one engine is required, that engine is operated for an interval and then switched off, while other engines carry the load. Two engines are operated in this instance for a small overlap in time; that overlap is helpful to switch from one to a second engine. The fuel pump distributes the fuel so that engine control can be obtained in this fashion. It is necessary to correlate the provision of the fuel along with the clutch control operation. When PP1 is provided with fuel and is switched on because it initially is powered up using the starter motor illustrated, and then it runs for a requisite interval, transfer of can then be shifted to PP2 by overlapping the operation of the two units for a few seconds. This enables PP2 to come up to speed. To accomplish this, the fuel pump must delivery fuel to the PP2, and the clutch 75 between the two units is then operated to make the transfer. The clutch 75 is therefore engaged to synchronize the operation of the two units.

Consider the use of all four engines where the load varies. In one instance, the load requires only one engine. Load conditions may change and thereby trigger operation of 2, 3, or 4 of the engines. This is signified by the pressure sensor 81. Speaking of the system in a pumping mode, the pressure sensor 81 senses excessive or deficient pressure. When the pressure gets outside an acceptable range, a signal is provided to the clutch control 80 to trigger operation of the clutches to engage additional engines. Consider as an example where the pumped fluid is refrigerant. Where the air conditioning load is increased, the pressure sensor 81 will note this change in conditions and provide the necessary signal to assure that 2, 3, or even 4 (and therefore all) of the engines are fired to provide the necessary pumped power for the system While the foregoing is directed to the preferred embodiment, the scope is determined by the claims which follow.

What is claimed is:

1. A power plant comprising:

(a) at least two similar engines wherein each comprises:
(1) a power piston and cylinder;
(2) a straight piston rod connected with said power piston;
(3) a pumped piston in a cylinder serially connected to said rod;
(4) wherein said power piston provides power for said rod and said rod is moved in axial reciprocating motion without rotation to operate said pump piston;

(b) a mechanical link connected between each of said engines so that the motion of one engine is timed with respect to the motion of the other of said engines so that said engines operate in timed, synchronized relationship, and wherein said mechanical link incorporates a clutch so that motion of one engine is selectively disconnected from another of said engines.

2. The apparatus of claim 1 wherein said clutch is operated by a clutch control.

3. The apparatus of claim 1 wherein said pump piston is in said cylinder, and said cylinder has opposing heads thereon, and further including connective passages to aid cylinder to enable pumping under pressure by movement of said pumped piston to provide a double acting pump stroke.

4. The apparatus of claim 1 wherein each of said similar engines incorporates a lubrication chamber for providing lubrication to said piston rod.

5. A power plant comprising:

(a) at least two similar engines wherein each comprises:
(1) a power piston in a cylinder;
(2) a straight piston rod connected with said power piston;
(3) a pumped piston in a cylinder serially connected to said rod;
(4) wherein said power piston provides power for said rod and said rod is moved in axial reciprocating motion without rotation to operate said piston pump; and (b) a link connected between each of said engines so that motion of one engine is timed with respect to motion of another of said engines so that said engines operate in timed synchronized relationship, wherein said link comprises
(1) an eccentric shaft;
(2) a mounting for said eccentric shaft with respect to said piston rod to enable motion to be imparted to said eccentric shaft;
(3) a sprocket drive connected to said shaft; and
(4) a flexible drive belt extending from said drive sprocket to impart timed movement from one to another of said engines.

6. A control system for at least two engines so that two of the engines can be selectively switched on wherein the control system cooperates with two engines and the engines each include a power piston at one end of a piston rod and a pump piston at the second end of the piston rod, and the control system comprises an engageable mechanical linkage from the first to the second engine capable of transferring mechanical power between the two engines, said two engines being independently operated and capable of operating alone without operation of the other two engines, and further including a control selectively and controllably connect the two engines for operation.

7. The apparatus of claim 4 wherein said control system comprises:

(a) a flexible endless belt drive connected to the first of said two engines and extending to the second of said two engines;

(b) a clutch in said flexible belt drive system connected to engage and disengage so that said flexible belt drive is selectively driven; and (c) a clutch control for switching said clutch off or on.

8. The apparatus of claim 6 wherein said control system controls operation of three or more engines and each of said engines is connected to at least one of the other of said engines by said engageable mechanical linkage wherein said three or more engines are independently operated and capable of operating alone.

9. The apparatus of claim 6 wherein said control system further includes means measuring the output of said pump piston, and including means for determining insufficient output so that one of said engines is supplemented by the operation of one of the other of said engines.

10. The apparatus of claim 9 wherein said means measures pump piston output pressure downstream of said pump piston to determine sufficiency.

11. The apparatus of claim 6 including a starter motor connected to one of said engines to enable starting of said one engine, and wherein said engageable mechanical linkage transfers mechanical power to the other of said engines to initiate starting of said other engine.

12. A power plant comprising:

(a) at least two similar engines wherein each comprises:
(1) a power piston and cylinder;
(2) a straight piston rod connected with said power piston;
(3) a pumped piston in a cylinder serially connected to said rod;
(4) wherein said power piston provides power for said rod and said rod is moved in axial reciprocating motion without rotation to operate said pump piston;

(b) a link connected between each of said engines so that the motion of one engine is timed with respect to the motion of the other of said engines so that said engines operate in time, synchronized relationship; and (c) wherein each of said engines incorporates said mechanical link and each of said mechanical links incorporates a clutch enabling said engine to be disconnected and independently switched off.

* * * * *